United States Patent [19]

Michel et al.

[11] Patent Number: 4,730,578

[45] Date of Patent: Mar. 15, 1988

[54] METHOD FOR OPERATING A HEATING BOILER PLANT AND APPARATUS SUITABLE THEREFOR

[75] Inventors: Alfred Michel, Erlangen; Hana Kostka, Nürnberg; Hermann O. Berg, Florstadt, all of Fed. Rep. of Germany; Louis Gosteli, Oetwil, Switzerland

[73] Assignee: Siemens A.G., Munich, Fed. Rep. of Germany

[21] Appl. No.: 453,796

[22] Filed: Dec. 27, 1982

Related U.S. Application Data

[63] Continuation of Ser. No. 234,724, Feb. 17, 1981, abandoned.

[30] Foreign Application Priority Data

Feb. 16, 1980 [DE] Fed. Rep. of Germany ..... 3006048

[51] Int. Cl.[4] ..... F22B 9/00

[52] U.S. Cl. ..... 122/49; 122/136 R

[58] Field of Search ..... 122/11, 12, 20 B, 49, 122/138 R; 237/55, 50, 13; 165/32, 86, 96, 142, 176

[56] References Cited

U.S. PATENT DOCUMENTS 2,131,336 9/1938 Sullivan ..... 122/11

4,151,874 5/1979 Kaburagi et al. ..... 165/DIG. 12

*Primary Examiner*—Henry A. Bennet

*Attorney, Agent, or Firm*—Kenyon & Kenyon

[57] ABSTRACT

A method for operating a heating plant having a boiler with a heat exchanger following the combustion chamber, such that it can be operated continuously and the exhaust gas temperature maintained at a predetermined value, in which a continuously controllable burner is employed and the effective heat exchanger area is adapted to the burner output.

8 Claims, 4 Drawing Figures

METHOD FOR OPERATING A HEATING BOILER PLANT AND APPARATUS SUITABLE THEREFOR

This is a continuation of application Ser. No. 234,724 filed Feb. 17, 1981 now abandoned.

BACKGROUND OF THE INVENTION

This invention relates to a method for operating a heating plant (heating boiler plant) which includes a heat exchanger following the combustion chamber of the boiler, as well as to apparatus for carrying out this method.

In conventional heating plants with boilers, oil burners are used in large numbers. Conventional oil burners of medium output rating atomize the heating oil by means of a nozzle and burn it with excess air in order to keep the soot development low. However, the atomizer burner output can be controlled continuously only with great difficulty and only within narrow limits. For this reason, atomizer burners for heating boiler plants are operated intermittently, so that the average of the output corresponds to the heat demand. Due to the intermittent operation, however, the boiler water temperature and, also, the gas temperature in the combustion chamber, as well as in the heat exchanger, in the exhaust gas line and/or in the stack, fluctuate, which is highly undesirable. For major fluctuations in the exhaust gas temperature should be avoided particularly because, at high temperatures, considerable energy losses occur and because, at low temperatures, a danger exists that the temperature will drop below the acid dew point and corrosion will occur.

SUMMARY OF THE INVENTION

It is an object of the present invention to develop a heating plant of the type mentioned at the outset in such a manner that it can be operated continuously and the exhaust gas temperature of the boiler maintained at a predetermined value, even in the event of variable heat demand and/or burner output proportional to the demand.

According to the present invention, this is achieved by using a continuously controllable burner, and matching the effective heat exchanger area to the burner output.

The heat demand, for instance, of a residential building, depends, like the outgoing heating system temperature, approximately linearly on the ambient air temperature. This relationship is shown schematically in FIG. 1. It can be seen from FIG. 1 that the required output varies approximately between 15 and 100% of the rated burner output (Outside air temperature: $-15°$ to $+15°$ C.). Since the transmitted heat in a heat exchanger is a function of the temperature difference and the heat exchanger area, the effective heat exchanger area is controlled, in the method according to the present invention, in accordance with a load dependent function. In this manner, the exhaust gas temperature is kept constant with the boiler operated with a continuously controllable burner, independently of the load proportional burner output, i.e., the exhaust gas temperature at the output of the heating boiler plant maintains a predetermined value within certain limits.

For the purposes of the present specification, "effective heat exchanger area" is understood to mean that part of the heat exchanging area, over which, for a given operating condition, the heat transfer essentially takes place. Since these are generally surfaces which are in contact with flowing exhaust gas (these are therefore essentially the so-called ancillary heating surfaces), the adaption of the effective heat exchanger area to the burner output advantageously takes place, according to the present invention, in such a manner that the number of individual elements of the heat exchanger, through which the exhaust gas flows, is a function monotonically increasing with the burner output.

In the case of a constant difference between the exhaust gas and the boiler water temperature it turns out that the number of individual elements of the heat exchanger, through which the exhaust gas flows, increases linearly with the burner output; proportionality therefore prevails. However, if the boiler is operated with a variable boiler water temperature in such a manner that, for low burner output, the boiler water temperature is low and therefore, the difference between the exhaust gas and the boiler water temperature is high, then the required number of individual elements of the heat exchanger through which the exhaust gas flows, increases more than linearly with the burner output. This results in a monotonically increasing function; an estimate yields $n \approx \dot{Q}/1-\dot{Q}$, where n is the number of individual elements of the heat exchanger through which the exhaust gas flows, and $\dot{Q}$ is the burner output.

When the method according to the present invention, evaporation burners such as "dish-type" burners, can be used, for instance. With the method according to the present invention for operating the heating plant, however, a gasification burner (combustor) is preferably used. Such a continuously controllable burner is described, for instance, in U.S. Pat. No. 4,230,443.

The known burner has the following essential structural features:

An antechamber for mixing an at least partially evaporated liquid fuel with primary air;

a catalytic device following the antechamber for converting the fuel vapor-air mixture into fuel gas;

a mixing chamber adjoining the catalytic device for mixing the fuel gas with secondary air;

a ring space which surrounds the antechamber, the catalytic device and the mixing chamber concentrically and is separated from the antechamber by a wall;

a conically expanding combustion chamber and a perforated burner plate of porous material which terminates the combustion chamber and to which the fuel gas-air mixture can be fed from the mixing chamber; and an ignition chamber which is arranged between the combustion chamber and the mixing chamber and is separated from the mixing chamber, so as to be protected against backfiring.

In the method according to the present invention, it is also of advantage to design the gasification burner used so that the ring space also encloses the ignition chamber and the conically expanding combustion chamber in the ring-like fashion and extends to the vicinity of the burner plate, and that, at this point, a primary air feed stub opens into the ring space (see in this connection: U.S. patent application Ser. No. 77,041). In addition, the side walls of the ignition chamber and of the combustion chamber can consist of metal and carry a ceramic lining. The ignition chamber may further be separated from the combustion chamber by a perforated wall in such a manner that the perforated area of the burner plate is larger than the perforated area of the perforated wall. At the housing, a flame monitoring device aimed at the perforated wall may also be provided.

The known gasification burner is based on the principle of two-stage combustion. In the first stage, heating oil is gasified in a catalytic reactor by partial oxidation with air at air numbers between 0.05 and 0.2, and preferably at about 0.1. The product gas so obtained, known as fuel gas, is then burned in the second stage with the rest of the air stoichiometrically and high temperatures are obtained in the combustion.

An advantageous apparatus for carrying out the method according to the present invention includes a tube bundle heat exchanger following the combustion chamber of the boiler. There is thus provided a heating plant having a controllable heat exchanger, the effective heat exchanger area thereof being adapted to the heat output of a continuously operated burner simply by suitably changing said heat output being variable, say, between 10 and 100% of the maximum heat demand, in such a manner that the exhaust gas temperature maintains a predetermined value. The necessary adaption of the effective heat exchanger area to the variable burner output is accomplished by a step wise connection of the tube bundle heat exchanger, which follows the combustion chamber, in such a manner that the number of open tubes of the heat exchanger is a function which increases monotonically with the burner output.

If a gasification burner of the above-mentioned type is used, which is operated stoichiometrically, i.e., without appreciable excess air, the number of open heat exchanger tubes, for instance, with constant boiler water temperature, is at the same time proportional to the quantity of the exhaust gas, since the latter is directly proportional to the burner output. On the other hand, however, this also means that for operation, according to the present invention, of a heating plant with constant boiler water temperature, the exhaust gas at the boiler output has not only constant temperature under all operating conditions, but also constant flow velocity.

The heat exchanger area can be changed by connecting and disconnecting tube bundle elements, in the heating boiler plant according to the present invention, through the use of throttle valves arranged within the individual elements, i.e., in the tubes, or the outlet of the tube bundle (in the individual elements). Advantageously, a step orifice can also be arranged at the tube bundle entrance, i.e., in the vicinity of the combustion chamber.

Preferably, the adaption of the heat exchanger area of the tube bundle heat exchanger to the burner output is accomplished by means of a rotary slide arranged at the outlet of the tube bundle. For operating the rotary slide, a positioning motor, for instance, may be provided. However, an expansion type thermostat at the outlet of the heat exchanger can also be considered. Controlling at the outlet of the heat exchanger has the advantage that a relatively cold exhaust gas is to be controlled; this is mechanically easier to accomplish. In addition, the tube bundle outlet is also more readily accessible.

The rotary slide or the step orifice or the throttle valves are controlled in dependence on the load, i.e., the burner output. The value of the load can be approximated, for instance, by the volume flow of heating oil fed to the burner. In a stoichiometrically operated gasification burner (air number $\lambda=1$), however, the air mass flow fed to the burner can also be utilized as a measure of load.

In the heating plant according to the present invention, a thermal sensor can also be arranged in the exhaust gas line. This thermal sensor can additionally be provided for controlling the rotary slide etc. By means of the thermal sensor arranged in the exhaust gas line, temperature deviations in the exhaust gas which result, for instance, from the change of the calorific value of the primary fuel used can be taken into consideration.

In a heating plant, the minimum burner output (during the transition period) is, as already mentioned, around 10 to 15% of the maximum output. A 15-kW burner, for instance, must accordingly be capable of being regulated down to about 2 kW. Considering the burner control range and the permissible exhaust gas temperature, the following result would therefore be obtained without the measures according to the present invention: If the boiler were designed for the lower limits of the exhaust gas temperature and the burner rating, the exhaust gas temperature would increase steeply for maximum burner output and the system efficiency would drop thereby. If on the other hand, the boiler were designed for the upper limit of the burner output, taking the maximally permissible exhaust gas temperature into consideration, a steep drop of the exhaust gas temperature with the detrimental consequences connected therewith would be obtained at partial load, although there would be no loss in efficiency.

The mentioned disadvantages are not present in the heating plant according to the present invention because constant exhaust gas temperature is assured by the above-explained measures. In this heating plant, the aim is that the variable part of the heat exchanger corresponds to the control range and non-variable part to the lower output limit of the burner. On the basis of the data mentioned above, the non-variable heat exchanger area of the combustion chamber, including the heat exchanger area of a tube of the tube bundle heat exchanger which is always open, advantageously corresponds, in the heating boiler plant according to the invention, to about 10% of the maximum burner output, while the area of the heat exchanger following the combustion chamber is controlled in such a manner that the exhaust gas temperature remains constant if the burner output is increased from 10 to 100%.

BRIEF DESCRIPTION OF THE DRAWINGS

FIG. 5 is a view similar to FIG. 2 of an alternate embodiment in which there is a throttle valve at the exit of each tube.

FIG. 6 is a view illustrating a step orifice.

DETAILED DESCRIPTION OF THE INVENTION

Figure 1:
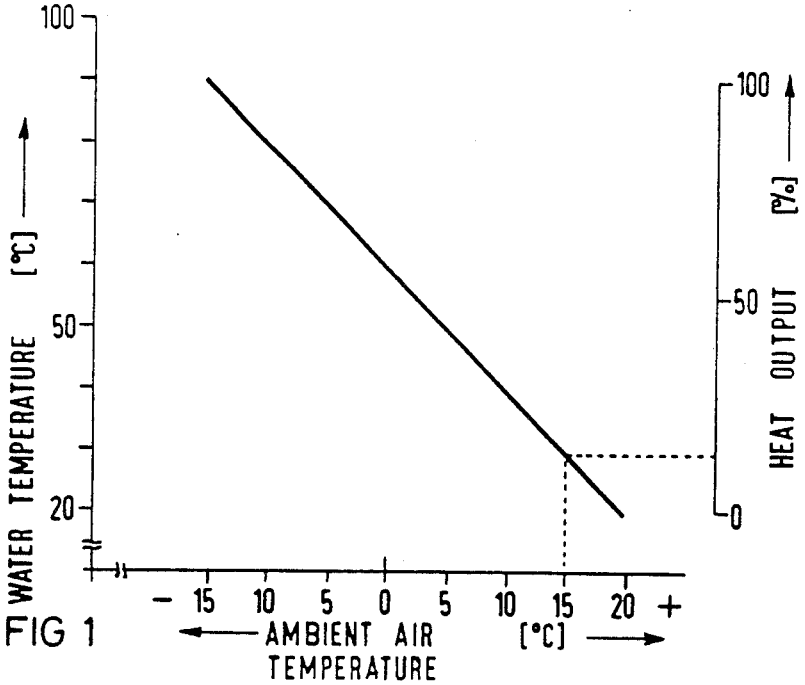
FIG. 1 is a plot of the boiler water temperature and the heat output of a heating plant as a function of the ambient air temperature.
Figure 2:
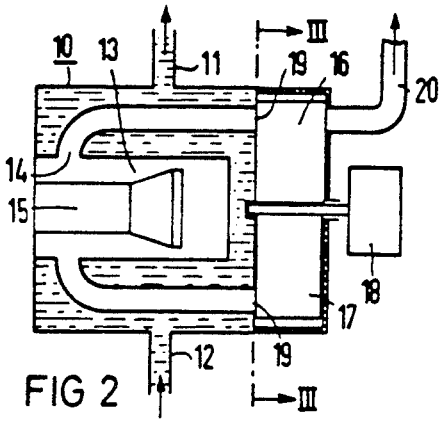
FIG. 2 is a schematic longitudinal section through an embodiment of the boiler plant according to the present invention.
Figure 3:
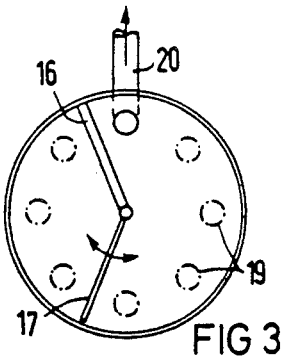
FIG. 3 is a cross section III—III through the embodiment according to FIG. 2.

As illustrated by FIGS. 2 and 3, the boiler of the heating plant 10 is provided with an outgoing pipe 11 and a return pipe 12 for the heated water. A controllable burner 15 extends into a combustion chamber 13, which is surrounded by a tube bundle heat exchanger 14.

Burner 15 may be a gasification burner of the type described in U.S. Pat. No. 4,230,443, the elements of which were described above. The combustion chamber 13 of the heating plant 10 is cylindrical and the tube bundle heat exchanger 14 is arranged coaxially thereto. In a heating plant with a maximum heat output of 15 kW, the combustion chamber has an inside diameter of, for instance, 195 mm and a length of 350 mm.

At the exit of the tube bundle heat exchanger 14, a fixed exhaust gas barrier 16 and a rotary slide 17 are arranged. The rotary slide 17 is actuated by a positioning motor 18 as a function of the burner output and successively releases the openings of the tubes 19 of the tube bundle heat exchanger 14. Through the open tubes 19, which are spaced regularly about the combustion chamber 13, the exhaust gas flows into the exhaust gas line 20 and from there into the stack. The range of rotation of the rotary slide 17 is set so that the combustion chamber 13 always communicates with the exhaust gas line 20 via at least one tube 19 of the tube bundle heat exchanger 14, i.e., one of the tubes 19 is always open.

The difference in the embodiment of FIG. 5 is that the openings of each of the tubes 19 contains a throttle valve which is used to control the opening and closing of that tube instead of the rotary slide. Alternatively, as shown by FIG. 6, a step orifice 23 may be utilized to sequentially uncover the ends of the tubes 19, which empty into the combustion chamber 13.

Also shown in FIG. 5 is a thermal sensor 21 in the exhaust gas line.

Figure 4:
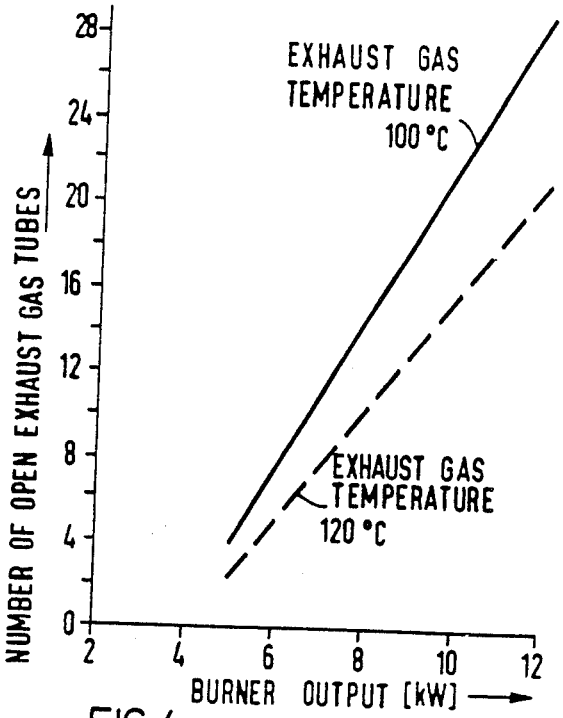
FIG. 4 is a graph showing the relationship between the number of open exhaust gas tubes and the burner output.

A heating plant which can be controlled continuously between about 2 and 12 kW, has, for instance 29 exhaust gas tubes which can be connected successively. For 4, 6, 8 and 10 kW heat output, the following exhaust gas composition is obtained: Soot number 0; 13.5% $CO_2$; 0.5% CO and 0.3 to 0.7% $O_2$. A constant exhaust gas temperature of about 100° C. can be obtained, as can be seen in FIG. 4, from 5 kW on by load-proportional addition of exhaust gas tubes. The exhaust gas temperature is therefore kept at a value of about 100° C. in order to maintain a sufficient margin from the acid dew point which is about 85° C. (use of a heating oil with a sulfur content of 0.3 to 0.55% by weight). A similar situation would apply to an exhaust gas temperature of 120° C., as is also shown in FIG. 4.

What is claimed is:

1. A method for operating a heating plant including a burner and a boiler having a combustion chamber with a heat exchanger following the combustion chamber, comprising using a continuously controllable burner and controlling said burner to provide the amount of heat needed and adapting the effective heat exchanger area to the burner output by using a heat exchanger with a plurality of individual elements and selecting the number of individual elements of the heat exchanger, through which the exhaust gas simultaneously flows, as a function which increases monotonically with the burner output.

2. A heating plant comprising:

(a) a continuously controllable burner and a boiler having a combustion chamber;

(b) a tube bundle heat exchanger with a plurality of individual elements following said combustion chamber; and (c) means to adapt the effective heat exchanger area of said heat exchanger to the boiler output by selecting the number of individual elements of the heat exchanger, through which the exhaust gas simultaneously flows, as a function which increases monotonically with the burner output.

3. Apparatus according to claim 2 wherein said burner comprises a gasification burner.

4. Apparatus according to claim 1, wherein said means to adapt comprise a rotary slide at the tube bundle exit.

5. Apparatus according to claim 1, wherein said means to adapt comprise a step orifice arranged at the tube bundle entrance.

6. Apparatus according to claim 1, wherein said means to adapt comprise a throttle valve arranged at the exit of each tube of the tube bundle heat exchanger.

7. Apparatus according to claim 1 and further including a thermal sensor in the exhaust gas line.

8. Apparatus according to claim 1 wherein the heat exchanger area of the combustion chamber corresponds to about 10% of the maximum burner output.

* * * * *